United States Patent [19]

Small

[11] Patent Number: 4,644,592

[45] Date of Patent: Feb. 24, 1987

[54] DISPOSABLE FLOOR MAT

[76] Inventor: John D. Small, 2236 Homeway Cir., Dallas, Tex. 75228

[21] Appl. No.: 843,704

[22] Filed: Mar. 25, 1986

[51] Int. Cl.[4] ..... A47K 3/12

[52] U.S. Cl. ..... 4/583; 428/40; 428/79; 428/187; 428/138

[58] Field of Search ..... 428/40, 79, 187, 138; 248/206.4; 4/581, 582, 583

[56] References Cited

U.S. PATENT DOCUMENTS

| | | | |
|---|---|---|---|
| 2,251,372 | 8/1941 | Nicholson | 428/133 |
| 2,503,174 | 4/1950 | Salvadore | 4/661 |
| 3,014,829 | 12/1961 | Curtin | 428/40 X |
| 3,034,140 | 5/1962 | Reynolds | 4/583 |
| 3,111,449 | 11/1963 | Gold et al. | 428/40 |
| 3,418,668 | 12/1968 | Anderson et al. | 4/583 |
| 3,616,134 | 10/1971 | Palenske | 428/154 X |
| 3,836,420 | 9/1974 | Freese | 4/582 X |
| 3,983,527 | 9/1976 | Ohsato et al. | 428/329 X |
| 3,999,224 | 12/1976 | Kollsman | 428/79 X |
| 4,328,275 | 5/1982 | Vargo | 428/156 |
| 4,584,218 | 4/1986 | Travis | 428/79 X |

*Primary Examiner*—Henry F. Epstein

*Attorney, Agent, or Firm*—Kanz, Scherback & Timmons

[57] ABSTRACT

Disclosed is a mat for temporary use on a surface subject to exposure to a highly aqueous environment. The mat includes a water repellent mat member having a surface adapted for frictional engagement with a human body part. A non-hygroscopic, fully releaseable, pressure sensitive adhesive film is applied to at least a part of the underside of the mat member. The adhesive film secures the mat to a surface in the water-filled environment and is readily removeable therefrom without leaving a residue of the adhesive film on the surface. A removeable liner covers the adhesive film prior to application of the mat member to the surface.

19 Claims, 5 Drawing Figures

DISPOSABLE FLOOR MAT

FIELD OF THE INVENTION

This invention relates generally to floor mats. More particularly, it relates to floor mats for use in a water-filled or saturated environment.

BACKGROUND OF THE INVENTION

Floor mats have been used in the past in a water-filled environment such as in or adjacent a bathtub or shower stall. That is, the floor mats are placed in an environment wherein they are partially or wholly immersed in water and the surrounding atmosphere has a correspondingly high moisture content. A mat is placed on the bottom of the bathtub, the floor adjacent the bathtub or another surface in the water-filled environment and presents an upper surface which frictionally engages feet or other human body parts. The floor mat enables a user to enter or leave the bathtub or shower stall and to walk about the water-filled environment safely without accidental slipping caused by the water.

One conventional floor mat design is a flexible elastomeric or rubber sheet having an embossed upper surface and a plurality of suction cups on a lower surface, such as disclosed in U.S. Pat. No. 3,034,140 to Reynolds. When the floor mat in Reynolds is pressed on a surface, the suction cups are compressed and secure the floor mat to the surface. The floor mat may be removed by forcibly disengaging the suction cups from the surface. However, this design is undesirable in several respects. Such a floor mat is relatively expensive and is intended for extended and repeated use. Sanitation is a primary concern in water-filled environments where disease causing bacteria, fungus, mildew and other organisms are commonly found. Over time the floor mat will become unsightly and a sanitation hazard due to the accumulation of these organisms on its surface. Diseases may be transferred by contact between multiple users of the floor mat, particularly in applications such as hotels and motels. Cleaning the mat is tedious, time consuming, labor intensive and therefore expensive, and is not always completely effective in sanitizing the floor mat. Finally, the suction cups are subject to deterioration over time and slippage of the floor mat may occur with respect to surface on which it is mounted.

One alternate design is a floor mat consisting of one or more plastic strips permanently adhered by an adhesive to a surface in a water-filled environment. The strips have a roughened upper surface. If left on the surface permanently, the adhesive on the strips may lose its tack over time due to the absorption of water and moisture from the environment. For the purposes of this application, "tack" is the property of an adhesive that enables it to form a bond of measureable strength immediately after being brought in contact with a surface under low pressure. If the deterioration of the adhesive continues, the strips may slip with respect to the surface, creating an obvious safety hazard. Moreover, this type of floor mat is even more difficult to maintain in a sanitary condition than the suction cup type floor mat which may at least be removed and cleaned periodically. Dirt and other contaminates also have an undesireable tendency to accumulate on and around the strips. Although relatively inexpensive compared to the suction cup type mat, adhesively applied strips are not intended for frequent replacement. Even if the strips are somehow removed, stringing or webbing is likely to occur in which at least a portion of the adhesive film is separated from the undersides of the strips and is deposited on the surface in the water-filled environment.

Disposable floor mats have been developed which attempt to avoid the sanitation and other problems associated with the floor mats previously discussed. U.S. Pat. No. 4,328,275 to Vargo discloses, an example of this type of disposable floor mat. In Vargo, the floor mat includes a liquid absorbing layer having a series of raised portions. The raised portions are treated with a liquid repellent to direct water and other fluids into the absorbent layer to avoid contact with a human foot. The bottom layer of the floor mat is impervious to liquids and is in contact with a surface to secure the floor mat thereto.

However, disposable floor mats such as disclosed in Vargo do not adequately relieve all of the problems associated with conventional floor mats. Specifically, Vargo relies solely on surface friction between the bottom surface of the floor mat and the surface on which the floor mat is placed to prevent the floor mat from slipping. This is frequently inadequate, particularly if the floor mat is applied over a preexisting layer of water on the surface which drastically reduces the coefficient of friction of the surface. Walking on the floor mat places a large and sudden lateral force on the mat, with obvious consequences if the floor mat is not secured properly. Moreover, by absorbing water and other fluids the weight of the floor mat is increased, making disposal of the mat more difficult.

SUMMARY OF THE INVENTION

This invention provides a disposable floor mat having a flexible, water-repellent mat member constructed of paper or the like with an upper surface adapted for frictional contact with human body parts. A non-hygroscopic, releaseable pressure sensitive adhesive is applied to at least a portion of the underside of the mat member for securing the mat member to a surface in a water-filled environment. A liner is releaseably secured to the adhesive film and is removed and disposed of prior to application of the mat member to the surface. The mat member is reliably secured to the surface during extended exposure to the water-filled environment, but may be easily removed from the surface without adhesive transfer to the surface. Indicia may be applied to the mat member or the liner.

In an alternate embodiment of the invention, the mat member is impregnated with a resin which creates a non-skid surface on the mat member during use, without altering the texture of the mat member upper surface. Alternatively, openings are formed in the mat member exposing portions of the adhesive film. The exposed adhesive film acts to releaseably grip human body parts while the floor mat is applied to a surface in the water-filled environment. The invention therefore provides an improved disposable floor mat which will withstand extended exposure to environments saturated with water. The invention further advantageously provides an improved disposable mat for use in a water-filled environment which is sanitary, inexpensive and easy to apply and remove.

BRIEF DESCRIPTION OF THE DRAWINGS

So that the manner in which the above recited features and advantages of the invention, as well as others which will become apparent to those skilled in the art, are obtained and can be understood in detail, a more particular description of the invention briefly summarized above may be had by reference to the embodiments thereof which are illustrated in the accompanying drawings, which drawings form a part of the specification and in which like numerals depict like parts in the several views. It is noted, however, that the appended drawings illustrate only a preferred embodiment of the invention and are therefore not to be considered limiting of its scope, for the invention may admit to other equally effective embodiments.

DETAILED DESCRIPTION OF THE INVENTION

Figure 1:
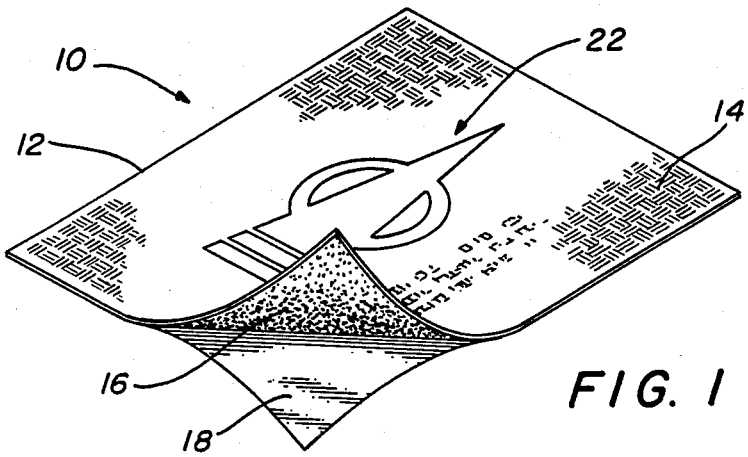
FIG. 1 is a perspective view of a floor mat constructed according to this invention.

Referring now to FIG. 1, the reference numeral 10 indicates a floor mat according to this invention for use in a water-filled environment. The floor mat includes mat member 12. The mat member may be constructed of any suitable material but is preferably constructed of a paper which is inexpensive, lightweight and abrasion and tear resistant. The mat member includes upper surface 14 adapted for frictional engagement with human body parts and, in particular, for secure contact with feet for assisting walking in the water-filled environment.

Figure 2:
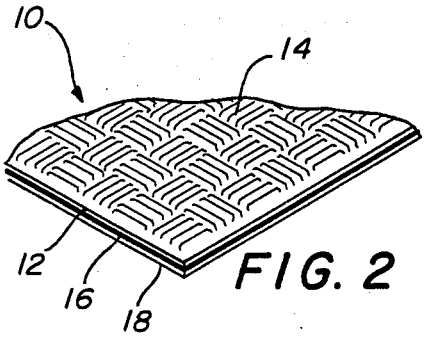
FIG. 2 is a magnified perspective view of a portion of the upper surface of the floor mat of FIG. 1.

Various means may be employed to adapt the upper surface of the mat member for frictional engagement with a human body part. For instance, the mat member may be embossed in a three dimensional pattern such as is shown in FIG. 2. Of course, the pattern may be altered as is found effective. Alternatively, the surface of the mat member may be provided with any roughened texture (not shown) which is effective.

The upper surface of the mat member is water and moisture repellent to prevent the water and moisture from adversely affecting the strength of the paper used to construct the mat member. Preferably, the mat member includes a coating (not shown) on its upper surface which is water repellant and acts as a sealer to insulate the mat from the water and moisture in the environment. Various materials may be used as a sealer and, in particular, a vinyl or acrylic coating applied as a spray has been found effective. A suitable sanitizing agent, such as a fungicide, may also be applied to the upper surface to eliminate potential disease-causing organisms. Chlorophenol is one such sanitizing agent.

The floor mat includes means for securing the mat member to a surface which will be exposed to an environment saturated with water. Specifically, adhesive film 16 is applied to at least a portion of the underside of the mat member. The adhesive film is non-hygroscopic. That is, the adhesive film will not absorb or retain any appreciable amount of moisture. Therefore, the floor mat may be used for an indefinite period of time in a highly aqueous environment without losing its tack or adhesive strength even though it is not intended for permanent installation. The adhesive film is pressure sensitive and additionally will retain its tack over the wide range of temperatures commonly experienced in a bath tub or shower. The adhesive film must adhere to the surface without allowing the floor mat to slip or move relative to the surface while in use. At the same time the peel strength of the adhesive film must not unduly interfere with removal of the floor mat from the surface. When the floor mat is removed from the surface, the adhesive film must be completely releaseable and must not exhibit any stringing or webbing which would result in adhesive transfer to the surface.

Examples of such adhesives are Avery K-6 and K-7 adhesives manufactured by Avery Label Company and marketed under the trademark KUM KLEEN. These adhesives are effective between −35° F. and +110° F., are non-hygroscopic, have suitable peel strengths and superior adhesive transfer properties and therefore may be employed as the adhesive film in the present invention.

Separator sheet or liner 18, shown partially separated from the mat member in FIG. 1, is provided to cover the adhesive film prior to use of the floor mat. The liner presents a slick surface to the adhesive film and is thus easily peeled off as the floor mat is applied to a surface. It is also possible to imprint various indicia such as pictures, images, logos, instructions for use and other useful information as indicated at 22 on the liner or to the upper surface of the mat member. The liner may be disposed of after removal from the floor mat. The adhesive film may be co-extensive with the mat member or applied to only a portion of the under side of the mat member such as along the edges thereof. In that case, the liner may be sized and shaped or divided into several discrete portions so as to cover only those portions of the mat member to which the adhesive film has been applied.

Figure 3:
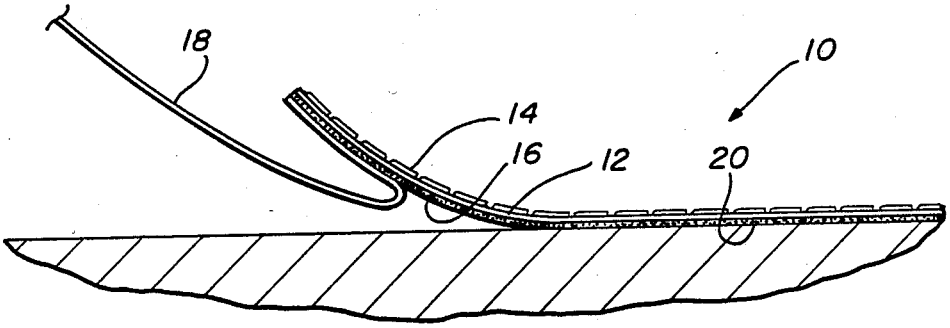
FIG. 3 is a magnified side view of a portion of the floor mat of FIG. 1 applied to a surface in an environment saturated with water.

As shown in FIG. 3, the mat member is applied to surface 20 in a water-filled environment, which may be the bottom surface of a bathtub, as liner 18 is peeled back to expose the adhesive film and secure the mat member. Even after extended use under the conditions herein described, the mat member may be peeled from the surface without leaving a residue of the adhesive film. The floor mat of this invention is easily and quickly applied to or removed from the desired surface and is constructed in an inexpensive manner so that the mat may be disposed of after a few uses or a single use. Thus, the accumulation of debris and the sanitation problems associated with conventional designs are completely eliminated while providing a safe surface for the user in a water-filled environment.

Figure 4:
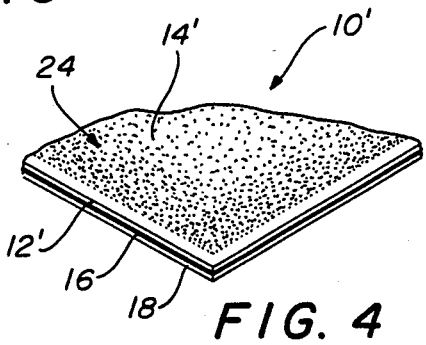
FIG. 4 is a magnified perspective view of an alternate embodiment of this invention in which the mat member is impregnated with a resin.

FIG. 4 shows an alternate embodiment of the floor mat in which in place of or in addition to the embossing of upper surface 14' of mat member 12', a resin or like adhesive is impregnated into the mat member as illustrated at 24. The resin content of the mat member is sufficient to releaseably grip a human body part in contact therewith without pulling the mat member from the surface in the water-filled environment.

Figure 5:
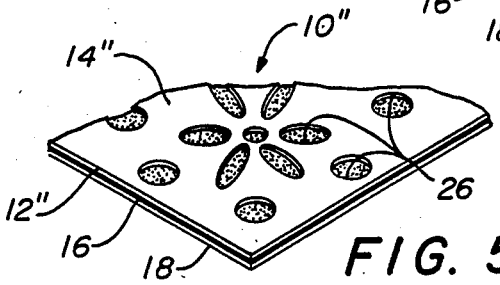
FIG. 5 is a magnified perspective view of yet another alternate embodiment of this invention in which a plurality of openings are formed in the mat member.

FIG. 5 illustrates another alternative embodiment 10'' of the floor mat in which in place of or in addition to the embossing of upper surface 14'' of mat member 12'', a plurality of openings 26 are formed in the mat member so as to expose portions of adhesive film 16. The exposed portions of the adhesive film are sufficient to releaseably grip a human body part placed in contact with the mat member without pulling the mat member from the surface in the water-filled environment. The size, shape, location or pattern of the openings in the mat member may be varied as is found functionally or aethetically desireable. One or more additional disposable liners or separator sheets (not shown) may be provided on the upper surface of the mat members to protect the exposed portions of the adhesive film in the various openings. These of course, and which are removed when the floor mat is applied to a surface in a water-filled environment.

Although the invention has been disclosed with regard to particular and preferred embodiments, these are advanced for illustrative purposes only and are not intended to limit the scope of this invention. For instance, it may be possible to construct the mat member of this invention from a plastic sheet or other suitable materials rather than from paper. Further, although depicted as rectangular in the drawings, the floor mat of this invention may be shaped in any size shape or configuration found suitable in a particular situation, and may comprise multiple elongated strips laid on a surface in parallel rows in a water filled environment. Likewise, The term "surface" as used herein in connection with the location in which the mat of the invention is to be used is not limited to floors but includes steps, inclined ramps and any other surface in such an environment into which a human body part is brought in contact. These variations remain within the spirit and scope of the invention as defined by the appended claims.

What is claimed is:

1. For temporary use on a surface subject to exposure to an environment saturated with water, a fully removeable and disposable mat comprising:

(a) a mat member having oppositely disposed first and second major faces;

(b) a sealer coating on said first major face providing a barrier between said first major face and the environment saturated with water;

(c) a fully releaseable pressure sensitive non-hygroscopic adhesive permanently secured to at least a portion of said second major face and adapted to releaseably secure said second major face to said surface subject to exposure to an environment saturated with water; and (d) a protective liner covering said adhesive and removeable therefrom to permit said adhesive to be releaseably attached to said surface subject to exposure to an environment saturated with water.

2. The mat defined in claim 1 including graphic indicia on said first major face of said mat member.

3. The mat defined in claim 1 including graphic indicia on said liner.

4. The mat defined in claim 1 wherein said first major face of said mat member is embossed so as to frictionally engage any human body part placed thereon.

5. The mat defined in claim 1 having a plurality of openings in said member which expose portions of the adhesive secured to said second major face.

6. The mat defined in claim 1 including a sanitizing agent applied to at least a portion of said first major face.

7. For temporary use on a surface subject to exposure to a water-filled environment, a removeable and disposable mat comprising:

(a) a mat member having a first major face and a second major face;

(b) a resin impregnated in said first major face which releaseably adheres to any human body part placed in contact therewith;

(c) a fully releaseable pressure sensitive non-hygroscopic adhesive permanently secured to at least a portion of said second major face and adapted to releaseably secure said second major face to said surface subject to exposure to a water-filled environment; and (d) a protective liner covering said adhesive and removeable therefrom to permit said adhesive to be releaseably attached to said surface subject to exposure to a water-filled environment.

8. The mat defined in claim 7 including graphic indicia on said first major face of said mat member.

9. The mat defined in claim 7 including graphic indicia on said liner.

10. The mat defined in claim 7 having a plurality of openings in said member which expose portions of the adhesive secured to said second major face.

11. The mat defined in claim 7 including a sanitizing agent applied to at least a portion of said first major face.

12. For temporary attachment on a surface subject to exposure to an environment saturated with water, a readily removeable mat comprising:

(a) a water repellent mat member having first and second oppositely disposed major faces, said first major face adapted for frictional engagement with human body parts;

(b) a fully releaseable pressure sensitive non-hygroscopic adhesive permanently secured to at least a portion of said second major face and adapted to releaseably secure said second major face to said surface subject to exposure to an environment saturated with water; and (c) a protective liner covering said adhesive and removeable therefrom to permit said adhesive to be removably attached to said surface subject to exposure to an environment saturated with water.

13. The mat defined in claim 12 including graphic indicia on said first major face of said mat member.

14. The mat defined in claim 12 including graphic indicia on said liner.

15. The mat defined in claim 12 having a plurality of openings in said member which expose portions of the adhesive secured to said second major face.

16. The mat defined in claim 12 including a sanitizing agent applied to at least a portion of said first major face.

17. An article of manufacture for use in forming a temporary and fully removeable friction face on a surface subject to exposure to a highly aqueous environment such as a bathtub or the like used by humans comprising:

(a) a sheet-like support medium having first and second oppositely disposed major faces;

(b) means formed in said first major face for frictionally engaging human body parts;

(c) a fully releaseable non-hygroscopic adhesive permanently secured to said second major face; and (d) removeable protective liner temporarily covering said releaseable adhesive.

18. The article of manufacture defined in claim 17 wherein said adhesive is a continuous film.

19. The article of manufacture defined in claim 18 wherein said sheet-like support medium has a plurality of openings therein which expose said adhesive film through said first major face.

* * * * *